United States Patent [19]

Shinomiya et al.

[11] 4,007,652

[45] Feb. 15, 1977

[54] CONTINUOUSLY VARIABLE CUTTING APPARATUS FOR ELONGATED SHEET MEMBERS

[75] Inventors: Tsutomu Shinomiya, Iwatsuki; Sanji Itoh, Tokyo, both of Japan

[73] Assignee: Kabushiki Kaisha Tomoku, Otaru, Japan

[22] Filed: Jan. 5, 1976

[21] Appl. No.: 646,869

[30] Foreign Application Priority Data

Jan. 9, 1975 Japan ..... 50-4654

[52] U.S. Cl. ..... 83/106; 83/177; 83/326; 83/408

[51] Int. Cl.[2] ..... B26F 3/00

[58] Field of Search ..... 83/177, 53, 341, 479, 83/480, 425.1, 425.2, 425.4, 106, 105, 486.1, 486, 487, 488, 408, 326

[56] References Cited

UNITED STATES PATENTS

| | | | |
|---|---|---|---|
| 823,250 | 6/1906 | Aldrich | 83/479 |
| 2,006,499 | 7/1935 | Fourness et al. | 83/177 X |
| 3,055,247 | 9/1962 | Goble | 83/479 X |
| 3,478,654 | 11/1969 | Willard | 83/479 X |
| 3,625,813 | 12/1971 | Eckelman | 83/177 X |
| 3,807,261 | 4/1974 | Couvreur | 83/326 X |
| 3,831,929 | 8/1974 | Hellmer | 83/479 X |
| 3,927,591 | 12/1975 | Gerber | 83/177 |

FOREIGN PATENTS OR APPLICATIONS

| | | | |
|---|---|---|---|
| 184,364 | 5/1955 | Austria | 83/177 |

*Primary Examiner*—Frank T. Yost

[57] ABSTRACT

Continuously variable cutting apparatus for elongated sheet members that are continuously supplied in a longitudinal moving direction and at desired intervals of widths; comprising several first projection nozzles connected to a high-pressure liquid source, the first nozzles being disposed to form at least two rows that extend transversely relative to the moving direction; and at least one second injection nozzle connected to a high-pressure liquid supply source, arranged to be driven to move transversely relative to the moving direction, said second nozzle being provided at a downstream position of the sheet members, below the first nozzles.

5 Claims, 6 Drawing Figures

CONTINUOUSLY VARIABLE CUTTING APPARATUS FOR ELONGATED SHEET MEMBERS

This invention relates to an apparatus in which a continuously supplied elongated sheet member is cut in the longitudinal direction thereof. The elongated member or members can be supplied by a corrugating machine.

Cutting arrangements of this kind have been known in which cutting-width intervals of the elongated member can be varied, to suit various member widths; various sizes and/or shapes of boxes and the like can be produced. In these arrangements or apparatus at least two groups of cutting rolls are circumferentially mounted on a frame body so as to be differentiated from one another in their positions, and the frame body is usually arranged to be turnable for adjustment.

During the time when one group of the cutting rolls is operated, giving a certain desired cutting-width interval, it is required in these conventional arrangements to vary or change the interval to another one, to which end the following procedure is required. The other group of the cutting rolls is previously adjusted as to the width intervals, and then the apparatus is stopped or its speed is substantially lowered, whereupon the frame body can be turned or rotated for adjustment, and the sheet member is cut. Hereafter the next end or actually start of the sheet member has to be newly inserted between the adjusted cutting rolls, and then the operation of the apparatus can be re-started.

Thus, the conventional arrangement requires that the apparatus is stopped at least once, for varying cutting-width intervals, or at least the speed has to be lowered substantially in order to be able to insert the sheet member between the previously adjusted cutting rolls. Such arrangements are disadvantageous in that they require substantial effort, trouble, and consequently they are expensive to operate. The arrangements are dangerous in operation, and additionally working efficiency is substantially lowered.

Particularly when the sheet member is a corrugated cardboard that is supplied continuously from a suitable machine, the same is usually under a drying process so that the stopping of the apparatus or its speed reduction causes a substantial inconvenience in that the corrugated cardboard is dried in excess to the required form curving, cracking and the like, and thus the same substantially deteriorates in quality.

Additionally, for the described adjustment of the cutting rolls, the unavoidable alignment of the cutting edges is very difficult so that the preceding adjustment thereof becomes almost impossible except if substantial time is expended. Consequently the conventional arrangement is also defective in that the same cannot be used when the variations of the cutting-width intervals are required in a relatively short time.

The present invention has for its object to provide an apparatus in which the foregoing deficiencies of the prior art are eliminated, so that the cutting-width intervals of the sheet members can be varied continuously in the longitudinal direction thereof, without stopping its movement or reducing the speed of the machine. Additionally, the sheet members can be cut, at the same time, transversely relative to the longitudinal moving direction.

In accordance with the major features of the invention, a continuously variable cutting apparatus is provided for elongated sheet members that are continuously supplied in a longitudinal moving direction and at desired intervals of width. The apparatus comprises several first projection nozzles connected to a high-pressure liquid source, these nozzles being disposed to form at least two rows that extend transversely relative to the moving direction. There is at least one second injection nozzle, connected to a high-pressure liquid supply source, arranged to be driven to move transversely relative to the moving direction, the second nozzle being provided at a downstream position of the sheet members, below the first nozzles.

The high-pressure liquid source and the similar liquid supply source could be the same or they could be different, in accordance with further features of the inventive apparatus.

Further objects, additional features and advantages of the invention will be better understood by way of the description that follows, with reference to the accompanying drawings wherein FIG. 1 is a schematic illustration of a preferred exemplary embodiment of the inventive continuously variable cutting apparatus for elongated sheet members;

Figure 1:
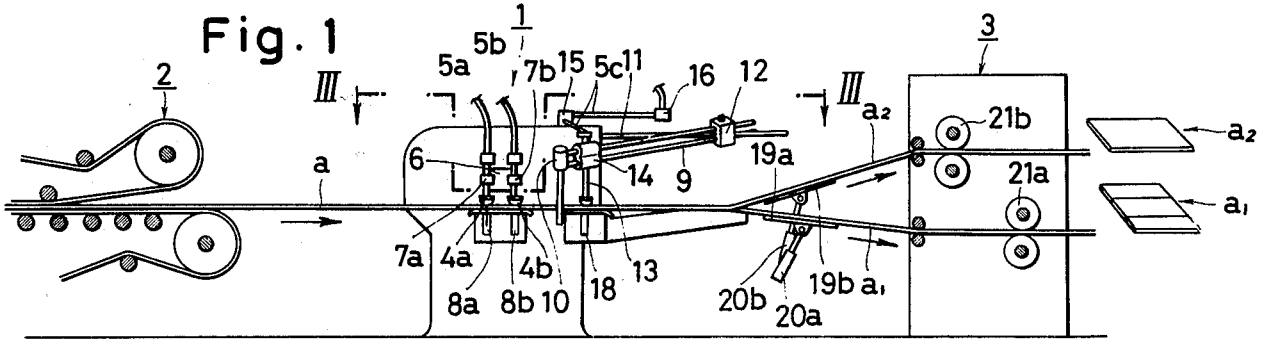
Figure 6:
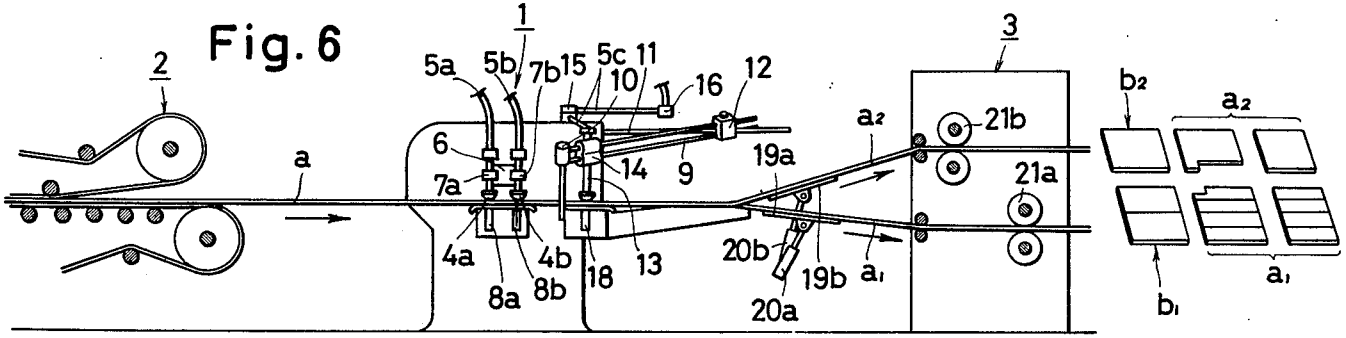
FIG. 6 is an illustration similar to FIG. 1 under a different operating condition.

In the drawings, numeral 1 denotes the inventive apparatus in general, disposed between a double facer mechanism 2 and a double cut-off mechanism 3 in a corrugating machine for manufacturing elongated sheet members *a*, e.g. of corrugated cardboard.

Several first projection nozzles 4*a*, 4*b* are connected through respective conduits 5*a*, 5*b* to a high-pressure liquid supply source (not shown). These nozzles are individually attached to respective members 7*a*, 7*b*, slidably mounted for adjustment in guide grooves made in both sides of a holding rod 6 provided above the sheet member *a* in a transverse direction thereof.

Thus, the projection nozzles 4*a*, 4*b* are disposed to form two lateral rows extending transversely to the direction of movement of the sheet member, and each of the nozzles in each row may be moved along the rod 6 to be adjustable in intervals.

Corresponding to these two rows of nozzles, two receiving grooves 8*a* are provided for receiving a projecting high-pressure liquid below the sheet member *a*.

Numeral 9 denotes a guide arm provided above the sheet member at a downstream position of its moving direction, below the projection nozzles 4*a*, 4*b*, and this arm 9 is pivotally attached at one end to a supporting rod 10 so as to be horizontally swingable. The arm is fixed by mounting at its other end to a distance mechanism 12 that is slidable but fixable on a side rod 11 provided in parallel with the moving direction of the sheet member *a*. Thus the guide arm 9 can be adjusted and fixed at any angular or inclination position.

A second projection nozzle 13 is provided on a holder member 14 that is slidably mounted on the guide arm 9. In order to permit this nozzle 13 to slide freely from one end to the other end of the arm 9, conduits 5*c* thereof are provided with a movable connector 15 interposed therebetween, and they are connected through a transit point 16 to a high-pressure liquid supply source, or the one mentioned before, in almost the same manner as the first projection nozzles 4*a*, 4*b*.

The member 14 of the nozzle 13 is connected to a driving source such as an electric motor (not shown) through an endless chain or the like 17, between suitable sprockets, so that the same can be driven to move along the arm 9. Numeral 18 denotes a receiving groove for the high-pressure liquid, projecting from the second nozzle 13, and numerals 19*a*, 19*b* denote selection guide plates for selectively supplying cut sections of the sheet member *a* to the double cut-off mechanism 3. These plates 19*a*, 19*b* are arranged to be movable upwards and downwards for selectively guiding the cut sheets by means of respective piston cylinder mechanisms 20*a*, 20*b*. Numerals 21*a*, 21*b* denote rotary shears in the double cut-off mechanism 3.

Figure 3:
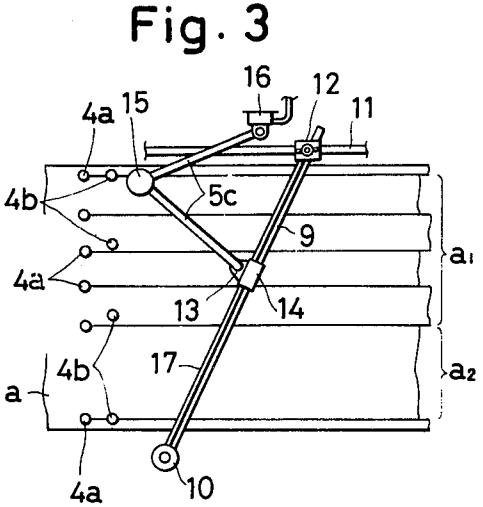
FIG. 3 is a sectional view taken along the line III - III in FIG. 1.

If the nozzles 4*a* are adjusted on one side in intervals by sliding of the members 7*a* and are operated to project linearly the high-pressure liquid therefrom, the sheet member, e.g., of corrugated cardboard, supplied continuously from the double facer mechanism 2 of the corrugating machine, is cut in the longitudinal direction into four lines or strips of small widths $a_1$ and a single line, strip or sheet of larger widths $a_2$, as shown in FIG. 3 as a matter of example.

Figure 4:
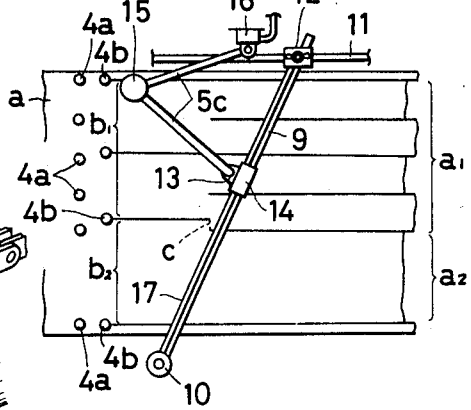
FIGS. 4 and 5 are sectional views similar to FIG. 3 under different operating conditions.
Figure 5:
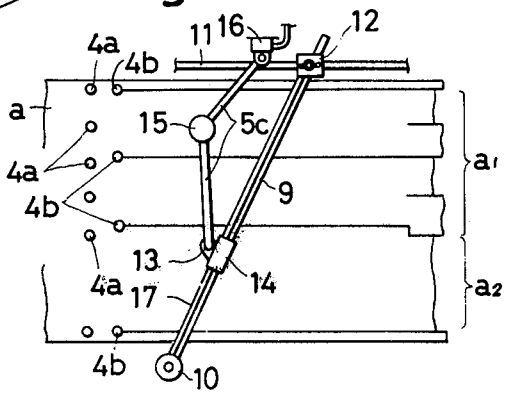
Figure 2:
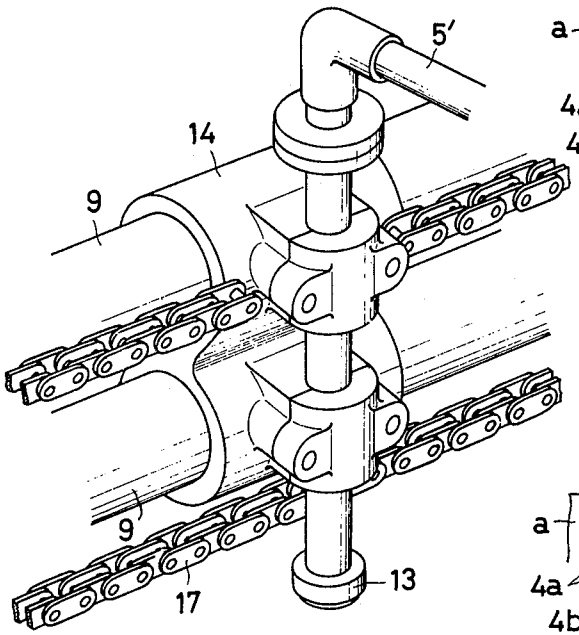
FIG. 2 is a perspective view of a projection nozzle portion of the apparatus.

If the sheet member is required to be varied in the cutting-widths intervals, the first projection nozzles 4*b* on the other side are properly adjusted in their intervals in almost the same manner as described above, and the high-pressure liquid emerging from the first nozzles 4*a* is stopped. At the same time such liquid is projected linearly from each of the first nozzles 4*b*, whereby the sheet member *a* is cut in the longitudinal direction into two lines or strips of small widths $b_1$ and a single line or strip of larger widths $b_2$, as shown for example in FIG. 4. By this changeover of the high-pressure liquid projection from the nozzle 4*a* to the nozzles 4*b*, there is formed a discontinuous portion *c* between the cut lines on the sheet member. When the portion *c* passes under the guide arm 9, the holder member 14 is driven by the chain 17 to travel across the portion *c*, and at the same time liquid is projected or discharged from the second nozzle 13 so as to cut the discontinuous portion *c* for connecting between the discontinued cut lines.

Thus, regardless of the fact that the sheet member has cut widths $a_1$, $a_2$ and cut widths $b_1$, $b_2$, it can be supplied continuously with two kinds of flow of the cut widths, such as $a_1$, $b_1$ and $a_2$, $b_2$, respectively. The two flows can be selectively or separately supplied to the double cut-off mechanism 3 in that the plates 19*a*, 19*b* are moved upwards and downwards, as required, by the action of the piston mechanisms 20*a*, 20*b*. The two flows of sheet members are respectively cut transversely by means of the shears 21*a*, 21*b*. Thus, the sheet member *a* having various cut widths such as $a_1$, $a_2$ and $b_1$, $b_2$ can be continuously supplied to the double cut-off mechanism 3.

Thus, according to the invention, the first projection nozzles 4*a*, 4*b*, connected to the high-pressure liquid supply source, are disposed to form at least two rows, extending transversely relative to the moving direction of the sheet member *a*, so that the latter can be cut continuously, while varying the cutting widths, by the arrangement that the first nozzles 4*a*, 4*b* in each row are previously adjusted to proper intervals, and the high-pressure liquid discharge is changed over from the one to the other.

Additionally, according to the invention, the second projection nozzle 13 is provided at a downstream position of the moving sheet member, below the first nozzles 4*a*, 4*b*, but movable transversely to the moving direction of the sheet member, so that any desired discontinuous portion between several cut lines formed by the operation of the first nozzles can be cut to interconnect therebetween.

Accordingly, the sheet member, *a*, can be supplied to the cut-off mechanism 3 continuously and separately, regardless of the existence of the varied cut widths. The continuously supplied sheet member can be cut in the longitudinal direction at any variable width interval, and in a continuous manner, and various cut widths of sheets can be obtained at a high working efficiency.

Especially in the case where the sheet member is subjected to a drying process, as in the case of corrugated cardboard that is continuously supplied from a corrugating machine, the same can be cut continuously at uniform speed, without requiring that the sheet supply is once stopped or reduced in speed as in conventional arrangements. As a result, the quality of the corrugated cardboard or the like material is substantially improved, and the cutting work efficiency is increased.

It should be understood that the invention admits of numerous modifications, minor additions and changes in respect of the exemplary, preferred apparatus embodiment described herein, within the scope and the limits of the here disclosed invention.

What I claim is:

1. A continuously variable cutting apparatus for elongated sheet members that are continuously supplied in a longitudinal moving direction thereof and at desired intervals of width; comprising several first projection nozzles connected to a high-pressure liquid source, said first nozzles being disposed to form at least two rows that extend transversely relative to the moving direction; at least one second injection nozzle connected to a high-pressure liquid source, arranged to be driven transversely relative to the moving direction, said second nozzle being provided at a downstream position of the sheet members, below said first nozzles; a holding rod provided above the sheet members in a transverse direction thereof, having guide grooves made in both sides of said rod; and members slidably mounted for adjustment in said grooves; and wherein said first nozzles are individually attached to said members.

2. The apparatus as defined in claim 1, further comprising a guide arm above the sheet members at the downstream position, below said first nozzles, and a holder member slidably mounted on said guide arm, and wherein said second nozzle is provided on said holder member.

3. The apparatus as defined in claim 2, further comprising a supporting rod, a side rod parallel with the moving direction of the sheet members, and a distance mechanism that is slidable and fixable on said side rod, and wherein said guide arm is pivotally attached at one end to said supporting rod so as to be horizontally swingable, and is fixed by being mounted at the other end to said distance mechanism.

4. The apparatus as defined in claim 2, further comprising driving means for said holder member of the second nozzle, so that said holder member is made to reciprocate along said guide arm.

5. The apparatus as defined in claim 1, further comprising guide means and cutter means at the downstream position of the sheet members, below said second nozzle, said cutter means forming part of a double cut-off mechanism; and wherein cut sections of the sheet members are selectively guided by said guide means towards an upper and a lower direction, and the cut sections are cut transversely by said cutter means.

* * * * *